US011585533B2

(12) United States Patent
Li et al.

(10) Patent No.: US 11,585,533 B2
(45) Date of Patent: Feb. 21, 2023

(54) ISOLATION SECTION SUPPRESSING SHOCK WAVE FORWARD TRANSMISSION STRUCTURE FOR WAVE ROTOR COMBUSTOR AND WAVE ROTOR COMBUSTOR

(71) Applicant: NANJING UNIVERSITY OF AERONAUTICS AND ASTRONAUTICS, Nanjing (CN)

(72) Inventors: Jianzhong Li, Nanjing (CN); Renchuan Zheng, Nanjing (CN); Wu Jin, Nanjing (CN); Qiongyao Qin, Nanjing (CN); Qian Yao, Nanjing (CN); Erlei Gong, Nanjing (CN)

(73) Assignee: NANJING UNIVERSITY OF AERONAUTICS AND ASTRONAUTICS, Nanjing (CN)

( * ) Notice: Subject to any disclaimer, the term of this patent is extended or adjusted under 35 U.S.C. 154(b) by 0 days.

(21) Appl. No.: 17/544,315

(22) Filed: Dec. 7, 2021

(65) Prior Publication Data

US 2022/0090789 A1 Mar. 24, 2022

Related U.S. Application Data

(63) Continuation of application No. PCT/CN2021/126332, filed on Oct. 26, 2021.

(30) Foreign Application Priority Data

Oct. 18, 2021 (CN) ..... 202111208639.5

(51) Int. Cl.
*F23R 7/00* (2006.01)
*F23R 3/56* (2006.01)

(52) U.S. Cl.
CPC . *F23R 7/00* (2013.01); *F23R 3/56* (2013.01)

(58) Field of Classification Search
CPC .... F23R 7/00; F23R 3/56; F02K 7/067; F02K 7/04; F02C 5/10; F02C 5/11
See application file for complete search history.

(56) References Cited

U.S. PATENT DOCUMENTS 1,980,266 A * 11/1934 Goddard ..... F02K 7/06 60/247
2,610,064 A * 9/1952 Goddard ..... F02K 7/06 60/39.77

(Continued)

FOREIGN PATENT DOCUMENTS

CN 103133138 A 6/2013
CN 206175067 U 5/2017

*Primary Examiner* — Ted Kim

(57) ABSTRACT

The present invention discloses an isolation section suppressing shock wave forward transmission structure for a wave rotor combustor and a wave rotor combustor, and belongs to the new concept field of unsteady combustion. The isolation section suppressing shock wave forward transmission structure for a wave rotor combustor includes a wave rotor and a gas inlet port, and the wave rotor is provided with several wave rotor channels. When the wave rotor rotates, the several wave rotor channels communicate with the isolation section sleeve sequentially through the fan-shaped hole. The present invention suppresses reflected shock waves by changing a flow blockage ratio and a shape of the pneumatic valve to consume back transmission pressure, which is beneficial to a fuel intake process, so that steady working of the wave rotor combustor in a state of deviating from a design point can be implemented.

8 Claims, 4 Drawing Sheets

(56) References Cited

U.S. PATENT DOCUMENTS

| | | | | | |
|---|---|---|---|---|---|
| 2,612,749 | A * | 10/1952 | Tenney | F02K 7/04 | 60/39.77 |
| 2,872,780 | A * | 2/1959 | Schmidt | F02K 7/06 | 60/39.77 |
| 3,362,431 | A * | 1/1968 | Pierre | F02K 7/16 | 60/262 |
| 4,002,414 | A * | 1/1977 | Coleman, Jr. | F04D 23/00 | 416/237 |
| 2017/0314463 | A1* | 11/2017 | Shimo | F23R 7/00 | |
| 2019/0257268 | A1* | 8/2019 | Roach | F02K 1/64 | |

* cited by examiner

ISOLATION SECTION SUPPRESSING SHOCK WAVE FORWARD TRANSMISSION STRUCTURE FOR WAVE ROTOR COMBUSTOR AND WAVE ROTOR COMBUSTOR

CROSS-REFERENCE TO RELATED APPLICATIONS

The present application is a continuation of International Patent Application No. PCT/CN2021/126332, filed on Oct. 26, 2021, which claims priority and benefits from Chinese Patent Application No. 202111208639.5, filed Oct. 18, 2021, which are hereby incorporated by reference in its entireties.

TECHNICAL FIELD

The present invention relates to the new concept field of unsteady combustion technologies, and more specifically, to an isolation section suppressing shock wave forward transmission structure for a wave rotor combustor and a wave rotor combustor.

BACKGROUND

A constant volume combustor can implement constant volume combustion internally, and has potentials of significantly reducing fuel consumption of a gas turbine and improving entire thermal efficiency. Both a detonation engine and a wave rotor combustor are new constant volume combustion devices. The wave rotor combustor can implement combination of a constant volume combustor and a stationary flow component, and therefore was once used as a dynamic pressure exchanger and topped in a gas turbine. Due to periodicity of working sequences and usage of many combustion channels of the wave rotor combustor integrating pressurization and combustion, when compared to other pressure gain combustor, the wave rotor combustor can better combine with turbomachinery and the like, and therefore has a quite high application value.

For example, the Chinese patent No. ZL201310018405.3 discloses an unsteady combustion-based wave rotor combustor with a pressurization function and a working method thereof. A wave rotor of the solution is formed by a plurality of channels, and an airflow of an outlet of the wave rotor combustor can be output steadily through sequential working of the plurality of channels while high thermal cycle efficiency of unsteady combustion and advantages of a pressurization technology are used. In another example, the Chinese patent No. ZL201621170672.8 discloses a mixed fuel formation device of a wave rotor combustor. The device includes a transitional pipe section and a wave rotor gas inlet port section connected to each other, where an upper wall surface of the wave rotor gas inlet port section is provided with several holes, each hole is connected to a fuel injection branch pipe, and each fuel injection branch pipe is connected to a fuel inlet main pipe through an independent valve; and an internal channel of the wave rotor gas inlet port section is provided with two flow deflectors, the flow deflectors divide the wave rotor gas inlet port section into three entrance regions, and the three entrance regions are filled with mixed gas of different concentrations.

However, similar to the detonation engine, during constant volume combustion, when pressure in the combustion chamber raises to a high level and deviates from a design point condition, when a gas inlet port is connected to the channel, high-pressure gas of a previous cycle may have not been exhausted, pressure in the channel is much higher than that in the gas inlet port, and shock wave forward transmission is formed consequently. Therefore, the wave rotor combustors of the foregoing two applications are prone to shock wave forward transmission in a working process, further affect a fuel intake process, and cause inconsistent working of the wave rotor combustors and advanced ignition of other channels, thereby affecting normal working of the wave rotor combustors.

SUMMARY

1. Technical Problems to be Resolved

An objective of the present invention is to overcome a disadvantage in the related art that high-pressure gas in channels of wave rotor combustors cannot be exhausted in time, easily leading to shock wave forward transmission. An isolation section suppressing shock wave forward transmission structure for a wave rotor combustor and a wave rotor combustor are provided, which are intended to suppress shock wave forward transmission of the wave rotor combustor, and improve the stability of the wave rotor combustor.

2. Technical Solutions

To achieve the foregoing objective, the technical solutions provided in the present invention are as follows:

The isolation section suppressing shock wave forward transmission structure for a wave rotor combustor provided in the present invention includes a wave rotor and a gas inlet port, where one end of the gas inlet port towards the wave rotor is provided with a sealing disc, an end portion of the wave rotor is in close contact with the sealing disc, and the sealing disc is provided with a fan-shaped hole; and the wave rotor is provided with several wave rotor channels. The gas inlet port is internally provided with an isolation section sleeve, the isolation section sleeve is internally provided with a pneumatic valve, the pneumatic valve has two valve plates, and free ends of the two valve plates are disposed towards the wave rotor and are away from each other; and when the wave rotor rotates, the several wave rotor channels communicate with the isolation section sleeve sequentially through the fan-shaped hole.

Further, a shape of the gas inlet port corresponds to a shape of the fan-shaped hole.

Further, the isolation section sleeve is disposed at a front end of the gas inlet port, so that when the wave rotor channel rotates, the wave rotor channel first communicates with the isolation section sleeve and then communicates with the gas inlet port.

Further, the two valve plates are hinged to each other, and the valve plate is provided with a limiting structure used for limiting an open degree of the pneumatic valve.

Further, the limiting structure includes a positioning pin and limiting holes opened on the two valve plates, the limiting holes are opened in an axial direction of the wave rotor channel, and two ends of the positioning pin are inserted into the limiting holes of the two valve plates respectively.

Further, a telescopic rod is further included, where the telescopic rod is disposed in the axial direction of the wave rotor channel, and the pneumatic valve is connected to the telescopic rod.

Further, two or more pneumatic valves are disposed, and the two or more pneumatic valves are connected to the same telescopic rod.

Further, the pneumatic valve further includes a slider, the two valve plates are hinged to the slider, and the slider is slidably connected to the telescopic rod.

The wave rotor combustor provided in the present invention includes the foregoing isolation section suppressing shock wave forward transmission structure.

3. Beneficial Effects

Compared with the related art, the following beneficial effects may be obtained by using the technical solutions provided in the present invention:

(1) In the isolation section suppressing shock wave forward transmission structure of the present invention, the two valve plates form a specific formation through cooperation of positions and angles, to change a flow channel area of the isolation section sleeve. Specifically, in a direction from the isolation section sleeve to the wave rotor, the two valve plates are streamlined, and in a direction from the wave rotor channels to the isolation section sleeve, the two valve plates are suddenly expanded, to decrease forward flow resistance of airflows and increase backward flow resistance. Further, cooperation of the two valve plates is used, to suppress reflected shock waves by changing a flow blockage ratio and a shape of the pneumatic valve to consume back transmission pressure, which is beneficial to a fuel intake process, so that steady working of the wave rotor combustor in a state of deviating from a design point can be implemented.

(2) In the present invention, through cooperation of the slider and the telescopic rod and cooperation of the positioning pin and the limiting holes, an open range of the pneumatic valve is controlled in a manner that the valve plates move relative to the positioning pin, so that a blockage area of the valve plates is adjusted, to further cause the pneumatic valve to produce a better suppression effect on shock wave forward transmission.

DETAILED DESCRIPTION

To further understand the content of the present invention, the present invention is described in detail with reference to the accompanying drawings and embodiments.

The structures, proportions, sizes, and the like shown in the accompanying drawings of this specification, in coordination with the content disclosed in this specification, are only used to help a person skilled in the art to read and understand, and they are not intended to limit the conditions under which the present invention can be implemented and therefore have no technical significance. Any modification to the structure, change to the proportional relationship, or adjustment on the size should fall within the scope of the technical content disclosed by the present invention without affecting the effects and the objectives that can be achieved by the present invention. In addition, the terms such as "upper", "lower", "left", "right", and "middle" mentioned in this specification are also merely for facilitating clear descriptions, but are not intended to limit the implementable scope. Without substantially changing the technical content, changes or adjustments of relative relationships thereof should also fall within the implementable scope of the present invention.

Figure 1:
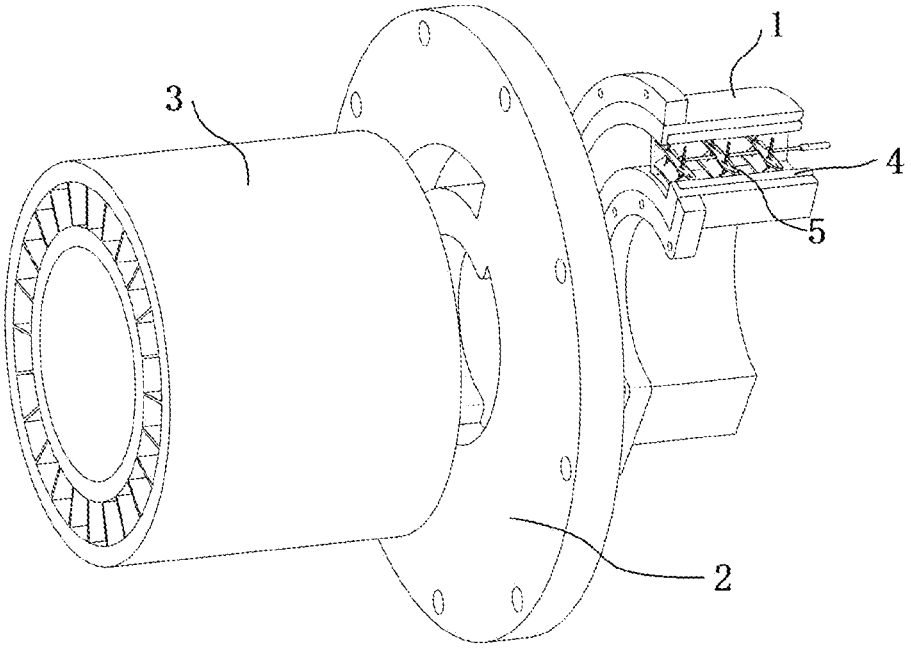
FIG. 1 is a schematic structural diagram of an isolation section suppressing shock wave forward transmission structure according to the present invention.

Referring to FIG. 1, this implementation provides an isolation section suppressing shock wave forward transmission structure for a wave rotor combustor, and the structure specifically includes a gas inlet port 1, a sealing disc 2, and a wave rotor 3. Specifically, the sealing disc 2 is disposed between the gas inlet port 1 and the wave rotor 3, and the sealing disc 2 is connected to one end of the gas inlet port 1 close to the wave rotor 3. The wave rotor 3 is in close contact with the sealing disc 2, to prevent gas leakage in the wave rotor 3 when the wave rotor 3 rotates relative to the sealing disc 2 and the gas inlet port 1.

Figure 2:
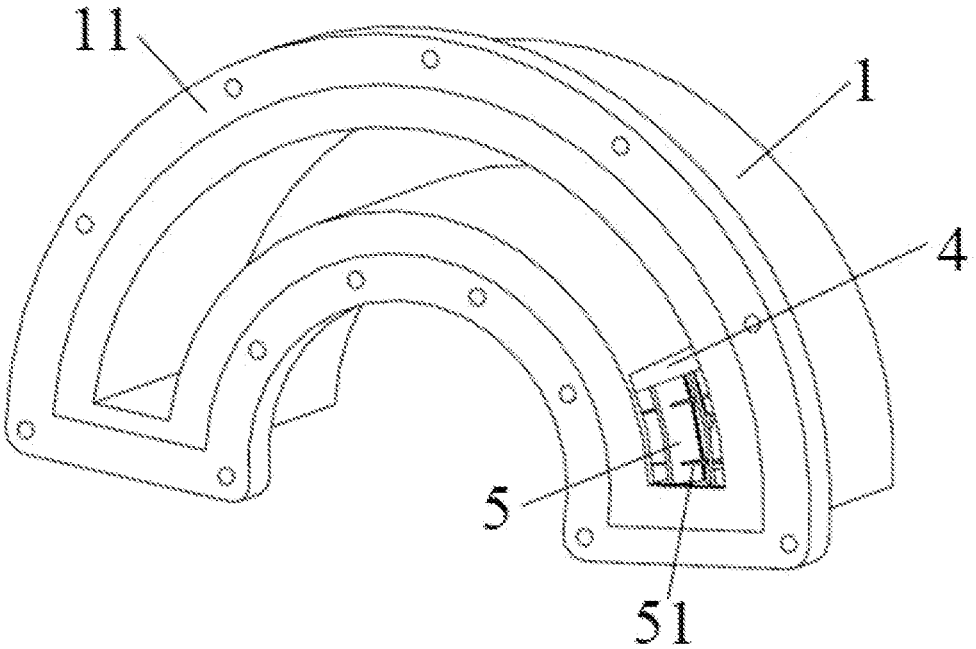
FIG. 2 is a schematic structural diagram of a gas inlet port according to the present invention.

Referring to FIG. 2, the middle of the gas inlet port 1 is hollow, for filling gas into the wave rotor 3. One side of the gas inlet port 1 connected to the sealing disc 2 is provided with a flange 11, both the flange 11 and the sealing disc 2 are provided with several threaded connection holes, and connection of the flange 11 and the sealing disc 2 is implemented through cooperation of the threaded connection holes on the flange 11 and the threaded connection holes on the sealing disc 2.

Figure 3:
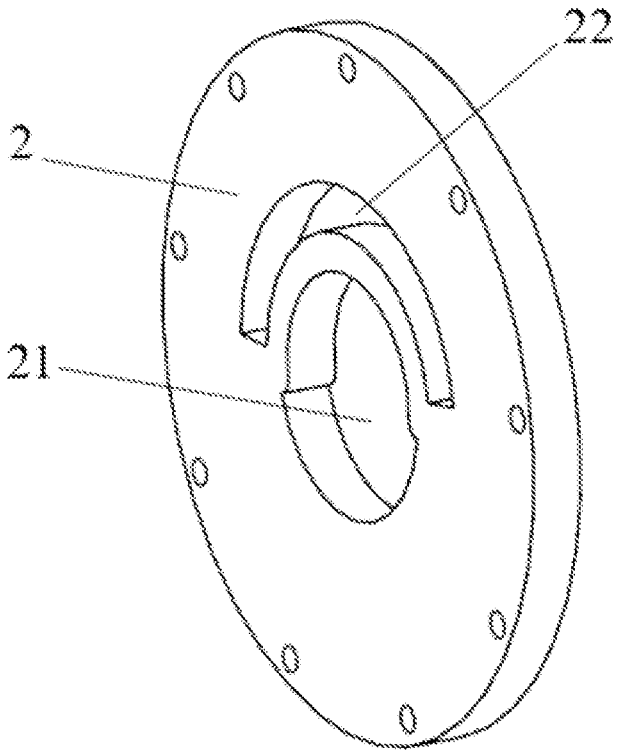
FIG. 3 is a schematic structural diagram of a sealing disc according to the present invention.

Referring to FIG. 3, the sealing disc 2 may be a circular structure, the sealing disc 2 is provided with a fan-shaped hole 22, and a shape of the gas inlet port 1 may correspond to a shape of the fan-shaped hole 22, so that the gas inlet port 1 can communicate with the wave rotor 3 through the fan-shaped hole 22.

Figure 4:
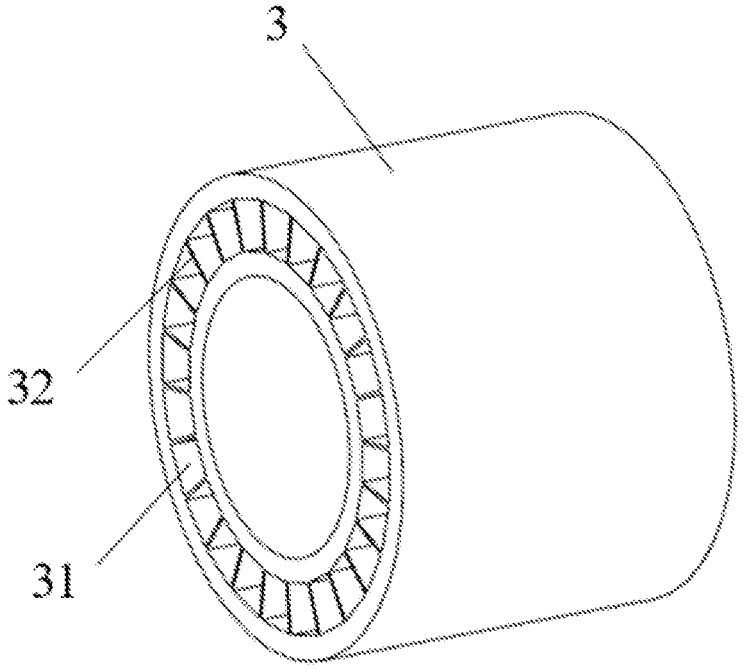
FIG. 4 is a schematic structural diagram of a wave rotor according to the present invention.

Referring to FIG. 4, the wave rotor 3 may be a sleeve structure. That is, the wave rotor 3 includes an inner sleeve and an outer sleeve, several rotor partition plates 32 may be disposed between the inner sleeve and the outer sleeve of the wave rotor 3, and the several rotor partition plates 32 are disposed at equal intervals in a circumferential direction of the wave rotor 3. Two adjacent rotor partition plates 32 form a wave rotor channel 31 with the inner sleeve and the outer sleeve jointly.

In a design point condition, a movement cycle process of one wave rotor channel 31 on the wave rotor 3 is specifically: The wave rotor channel 31 first rotates in a rotation direction of the wave rotor 3, and when the wave rotor channel 31 rotates to a first position and starts one cycle, the wave rotor channel 31 communicates with a front end of the gas inlet port 1 through the fan-shaped hole 22, and gas in the gas inlet port 1 enters the wave rotor channel 31; the wave rotor channel 31 then rotates to a second position, the wave rotor channel 31 communicates with a rear end of the gas inlet port 1 through the fan-shaped hole 22 at the position, and the wave rotor channel 31 completes gas intake between the front end and the rear end of the gas inlet port 1; after the wave rotor channel 31 reaches the second position and continues to rotate, the wave rotor channel 31 no longer communicates with the gas inlet port 1; the wave rotor channel 31 then rotates to a third position and starts ignition, and rotates to a fourth position and starts to exhaust gas; and the wave rotor channel 31 finally returns to the first position to complete one cycle.

In the design point condition, after the wave rotor channel 31 completes one cycle, gas in the wave rotor channel 31 is combusted completely, and temperature of the wave rotor channel 31 is greatly increased and much higher than room temperature. Then, if the wave rotor 3 enters an off-design point condition, namely, a rotation speed of the wave rotor is higher than a designed rotation speed, or the gas inlet port cannot fill gas into the wave rotor channel according to a design condition, and gas remained in the wave rotor channel may obtain a certain pressure gain, so that air pressure of the gas in the wave rotor channel 31 is higher than air pressure in the gas inlet port 1. When the wave rotor channel 31 communicates with the gas inlet port 1, the gas in the wave rotor channel 31 may flow into the gas inlet port 1, to interfere with gas flow in the gas inlet port 1, further leading to shock wave forward transmission.

Referring to FIG. 1, in this implementation, to resolve the foregoing problem, an isolation section sleeve 4 is disposed in the gas inlet port 1. The isolation section sleeve 4 is internally provided with a pneumatic valve 5, the pneumatic valve 5 is used to change flow resistance of a first airflow L1 of the gas inlet port 1 to the wave rotor channel 31 and flow resistance of a second airflow L2 of the wave rotor channel 31 to the gas inlet port 1, so as to suppress shock wave forward transmission.

Figure 7:
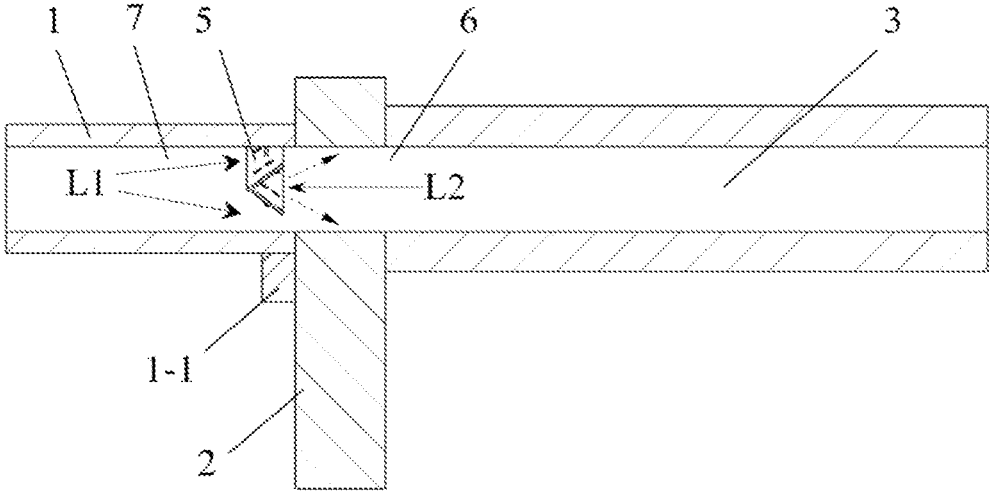
FIG. 7 is a schematic diagram of a shock wave forward transmission suppression principle according to the present invention.

Specifically, the pneumatic valve 5 may have two valve plates, and free ends of the two valve plates are disposed towards the wave rotor 3. The free ends of the two valve plates are away from each other and form a "V-shaped" structure, and an opening of the "V-shaped" structure is towards the wave rotor channel 31. Referring to FIG. 7, when the wave rotor channel 31 communicates with the isolation section sleeve 4 in the gas inlet port 1, a high pressure region 6 of high-pressure gas is formed in the wave rotor channel 31, and the gas inlet port 1 is a low pressure region 7. When the first airflow L1 of the low pressure region 7 flows through the pneumatic valve 5, flow resistance is decreased under guidance of the streamlined structure; and when the second airflow L2 of the high pressure region 6 flows to the pneumatic valve 5, a backflow is generated and shock waves are reflected under blocking of the sudden expansion structure. Therefore, by adjusting the pneumatic valve 5, this implementation can effectively reduce pressure of back transmitted shock waves and has a relatively small forward flow loss.

To improve a shock wave forward transmission suppression effect, the isolation section sleeve 4 may be disposed at the front end of the gas inlet port 1. In this case, when the wave rotor channel 31 rotates, the wave rotor channel first communicates with the isolation section sleeve 4, so that the wave rotor channel 31 always communicates with the isolation section sleeve 4, and the wave rotor channel then communicates with the gas inlet port 1 after pressure in the wave rotor channel 31 is decreased, thereby suppressing shock wave forward transmission.

As a further optimization solution of the pneumatic valve 5, the two valve plates may be hinged to each other, and the valve plate is provided with a limiting structure used for limiting an open degree of the pneumatic valve. After the wave rotor channel 31 communicates with the isolation section sleeve 4, if the air pressure in the wave rotor channel 31 is apparently higher than the air pressure in the isolation section sleeve 4, the two valve plates of the pneumatic valve 5 are away from each other under action of the pressure difference, to further increase a sudden expansion angle, thereby improving a blockage effect to the second airflow L2. After the wave rotor channel 31 communicates with the isolation section sleeve 4 for a period of time, the air pressure in the isolation section sleeve 4 is equal to the air pressure in the wave rotor channel 31 or even higher than the air pressure in the wave rotor channel 31, the two valve plates of the pneumatic valve 5 are close to each other under action of the pressure difference, to increase a flow speed of the first airflow L1.

In addition, the valve plate is further provided with a limiting structure that can limit an open angle of the pneumatic valve 5, to prevent the pneumatic valve 5 from opening excessively due to extremely high air pressure in the wave rotor channel 31 and completely blocking the isolation section sleeve 4. In addition, directions of the streamlined structure and the sudden expansion structure of the two valve plates may be prevented from changing to opposite under action of a large pressure difference.

Specifically, the limiting structure may include a positioning pin 51 and limiting holes 52 opened on the two valve plates, the limiting holes 52 are opened in an axial direction of the wave rotor channel 31, and two ends of the positioning pin 51 run through the limiting holes 52 of the two valve plates and are connected to an inner sidewall of the isolation section sleeve 4 respectively. When an angle of the two valve plates of the pneumatic valve 5 changes, the positioning pin 51 may come into contact with front portions and rear portions of the limiting holes 52 respectively, to limit the open angle of the two valve plates of the pneumatic valve 5.

To further optimize the adjustment to the angle of the two valve plates of the pneumatic valve 5 and the adjustment to a blockage degree of the isolation section sleeve 4, a telescopic rod 54 may be further included. The telescopic rod 54 may be disposed in the axial direction of the wave rotor channel 31, and the pneumatic valve 5 may be connected to the telescopic rod 54. During adjustment, the telescopic rod 54 may drive the pneumatic valve 5 to move relative to the positioning pin 51 under driving of a motor, to change relative positions of the limiting holes 52 and the positioning pin 51.

Figure 6:
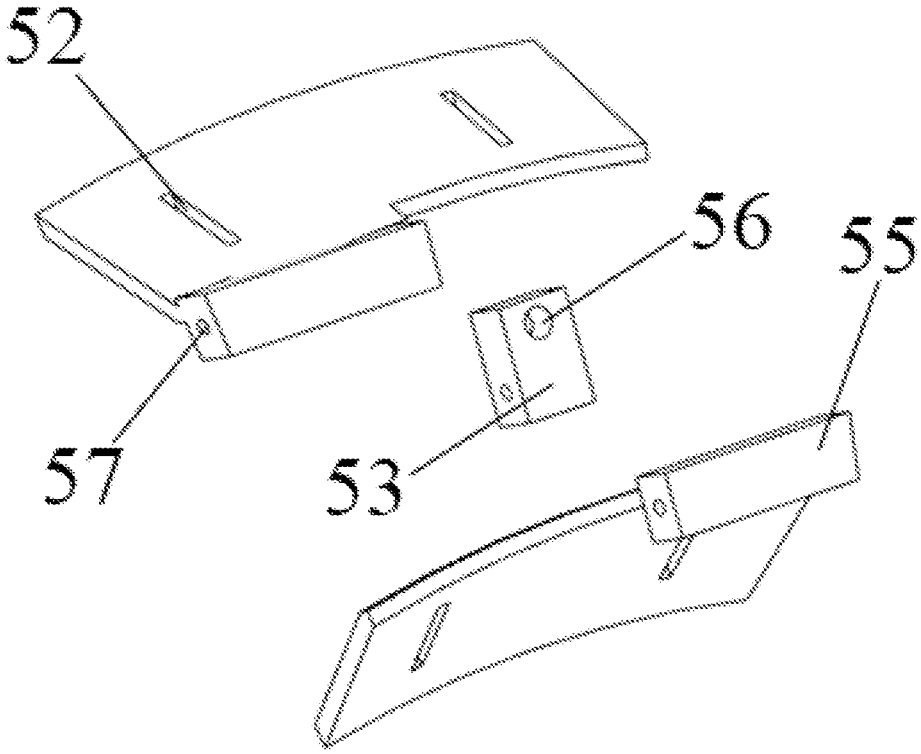
FIG. 6 is a schematic diagram of a cooperation relationship of valve plates according to the present invention.

In addition, referring to FIG. 6, the valve plate of the pneumatic valve 5 may be provided with a rotation rod 55, and a hinge hole 57 is opened on the rotation rod 55. A slider 53 may be disposed between the two valve plates, and the slider 53 may be provided with a rotation shaft, to hinge the valve plate to the slider 53 through cooperation of the rotation shaft and the hinge hole 57, thereby indirectly implementing hinge of the two valve plates. The slider 53 may be further provided with a fixed connection hole 56, and the pneumatic valve 5 is connected to the telescopic rod 54 through the fixed connection hole 56.

Figure 5:
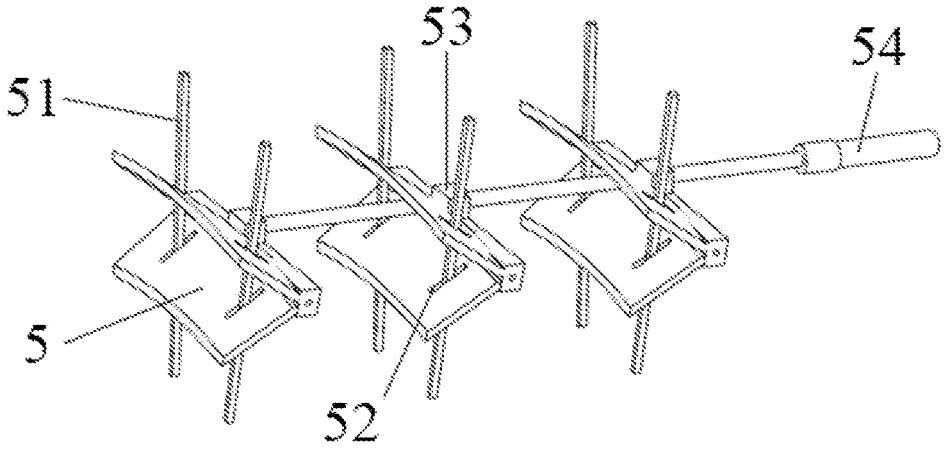
FIG. 5 is a schematic structural diagram of a pneumatic valve according to the present invention.

To further improve the shock wave forward transmission suppression effect for the wave rotor channel, referring to FIG. 5, the isolation section sleeve 4 may be internally provided with two or more pneumatic valves 5, and the two or more pneumatic valves 5 may be driven by the same telescopic rod 54.

This implementation further provides a wave rotor combustor, and the wave rotor combustor includes the isolation section suppressing shock wave forward transmission structure in this implementation. In addition, the sealing disc 2 of the isolation section suppressing shock wave forward transmission structure may be further provided with a cooperation hole 21, and the cooperation hole 21 is used for connection to a rotation shaft of the wave rotor combustor.

The foregoing exemplarily describes the present invention and an implementation thereof, and the description is not restrictive. The accompanying drawings only show one of the implementations of the present invention, and an actual structure is not limited thereto. Therefore, similar structures and embodiments designed by a person of ordinary skill in the art inspired by the disclosure herein without departing from the idea of the present invention and without creative efforts shall fall within the protection scope of the present invention.

What is claimed is:

1. An isolation section suppressing shock wave forward transmission structure for a wave rotor combustor, comprising a wave rotor and a gas inlet port, a side of the gas inlet port towards the wave rotor being coupled to a sealing disc, an end portion of the wave rotor being in close contact with the sealing disc, and the sealing disc being provided with a fan-shaped hole; and the wave rotor being provided with several wave rotor channels, wherein the gas inlet port is provided with an isolation section sleeve, the isolation section sleeve is provided with a pneumatic valve, the pneumatic valve has two valve plates, and free ends of the two valve plates are disposed towards the wave rotor and are away from each other, the two valve plates are streamlined in a direction from the isolation section sleeve to the wave rotor to decrease forward flow resistance of airflows, and the two valve plates expand in a direction from the wave rotor channels to the isolation section sleeve to increase backward flow resistance, the two valve plates are hinged to each other, and the valve plates are provided with a limiting structure which limits an opening degree of the pneumatic valve, wherein the limiting structure comprises a positioning pin and limiting holes opened on the two valve plates, the limiting holes each extend in an axial direction of the wave rotor channel, and two ends of the positioning pin run through the limiting holes of the two valve plates and are respectively connected to an inner sidewall of the isolation section sleeve, wherein, the isolation section suppressing shock wave forward transmission structure further comprises a telescopic rod, wherein the telescopic rod is disposed in the axial direction of the wave rotor channel, and the pneumatic valve is connected to the telescopic rod, wherein, when the wave rotor rotates, the several wave rotor channels communicate with the isolation section sleeve sequentially through the fan-shaped hole, wherein the gas inlet port has a hollow extending in a circumferential direction of the gas inlet port, and the isolation section sleeve is disposed at an end portion in the circumferential direction of the hollow in the gas inlet port, so that when the wave rotor channel rotates, the wave rotor channel first communicates with the isolation section sleeve and then communicates with a portion of the hollow other than the end portion of the hollow.

2. The isolation section suppressing shock wave forward transmission structure for a wave rotor combustor according to claim 1, wherein a shape of the gas inlet port corresponds to a shape of the fan-shaped hole.

3. The isolation section suppressing shock wave forward transmission structure for a wave rotor combustor according to claim 1, wherein two or more pneumatic valves are disposed, and the two or more pneumatic valves are connected to the same telescopic rod.

4. The isolation section suppressing shock wave forward transmission structure for a wave rotor combustor according to claim 1, wherein the pneumatic valve further comprises a slider, the two valve plates are hinged to the slider, and the slider is slidably connected to the telescopic rod.

5. A wave rotor combustor, comprising the isolation section suppressing shock wave forward transmission structure according to claim 1.

6. The isolation section suppressing shock wave forward transmission structure for a wave rotor combustor according to claim 1, wherein the gas inlet port includes an inner portion and a flange, the inner portion surrounding the hollow has a shape corresponding to the fan-shaped hole of the sealing disc, the flange being disposed over an outer surface of the inner portion and coupled to the sealing disc.

7. The isolation section suppressing shock wave forward transmission structure for a wave rotor combustor according to claim 6, wherein the isolation section sleeve is disposed only at the end portion of the hollow.

8. The isolation section suppressing shock wave forward transmission structure for a wave rotor combustor according to claim 1, wherein the structure suppresses the shock wave forward transmission from the wave rotor channels to the gas inlet port after combustion.

* * * * *